US007965966B2

(12) United States Patent
Kim et al.

(10) Patent No.: US 7,965,966 B2
(45) Date of Patent: Jun. 21, 2011

(54) TRANSFERRING UNIT AND IMAGE FORMING APPARATUS INCLUDING THE SAME

(75) Inventors: Yoon-Hwak Kim, Suwon-Si (KR); Jong-Woo Kim, Yongin-Si (KR); Hyun-Ki Cho, Hanam-Si (KR); Young-Dae Ko, Suwon-Si (KR); Jong-Tae Kim, Gwacheon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/575,853

(22) Filed: Oct. 8, 2009

(65) Prior Publication Data

US 2010/0092217 A1 Apr. 15, 2010

(30) Foreign Application Priority Data

Oct. 14, 2008 (KR) ..... 10-2008-0100448

(51) Int. Cl.
*G03G 15/01* (2006.01)
*G03G 15/16* (2006.01)

(52) U.S. Cl. ..... 399/299; 399/302

(58) Field of Classification Search ..... 399/299, 399/302, 66

See application file for complete search history.

(56) References Cited

U.S. PATENT DOCUMENTS

| | | | | |
|---|---|---|---|---|
| 7,218,883 | B2 * | 5/2007 | Aruga et al. | 399/302 |
| 2003/0219288 | A1 * | 11/2003 | Hagiwara et al. | 399/299 |
| 2006/0210322 | A1 * | 9/2006 | Watanabe et al. | 399/299 |
| 2007/0116497 | A1 * | 5/2007 | Yamazaki | 399/299 |
| 2008/0317518 | A1 * | 12/2008 | Fukuhara | 399/302 |

FOREIGN PATENT DOCUMENTS

| | | | |
|---|---|---|---|
| JP | 2002-108172 | A * | 4/2002 |
| KR | 10-2008-0012581 | | 2/2008 |

OTHER PUBLICATIONS

Machine translation of JP 2002-108172 A dated Oct. 18, 2010.*
English language abstract of KR 10-2008-0012581, published Feb. 12, 2008.

* cited by examiner

*Primary Examiner* — Sophia S Chen
(74) *Attorney, Agent, or Firm* — Stanzione & Kim, LLP

(57) ABSTRACT

Disclosed are a transfer unit and an image forming apparatus having the same. The apparatus can include multiple members configured to carry developer associated with color images. The transfer unit can include multiple rollers each disposed to opposingly face a respective corresponding one of the members, a belt interposed between the rollers and the members, and a device configured to support the rollers. The rollers can include a first roller at one end of the transfer unit, a second roller at an opposite end and one or more middle rollers arranged between the first and second rollers. The device can be configured such that a rotation center of the first roller and a rotation center of the second roller define a first plane and a rotation center of the one or more middle rollers defines a second plane parallel to but not co-planar with the first plane.

15 Claims, 7 Drawing Sheets

TRANSFERRING UNIT AND IMAGE FORMING APPARATUS INCLUDING THE SAME

CROSS-REFERENCE TO RELATED APPLICATION

This application claims priority from Korean Patent Application No. 10-2008-0100448, filed on Oct. 14, 2008 in the Korean Intellectual Property Office, the disclosure of which is incorporated herein by reference in its entirety.

TECHNICAL FIELD

Apparatuses and methods consistent with the present disclosure relate generally to a transferring unit and an image forming apparatus having the same, and more particularly, to a transferring unit capable of reducing color registration error and an image forming apparatus having the same.

BACKGROUND OF RELATED ART

An electro-photographic image forming apparatus can perform a series of processes, such as, for example, electrical charging, image exposure, image development, image transfer, image fixing, and cleaning to form an image on a print medium using toner. Examples of an electro-photographic image forming apparatus may include a laser printer, a copying machine, a multifunction peripheral device, and other like devices.

Such an electro-photographic image forming apparatus can be classified as a multi-path type or a single-path type based on the method used in forming a color image.

A single-path type electro-photographic image forming apparatus can include four photosensitive bodies on which toner images typically of four colors (e.g., yellow (Y), magenta (M), cyan (C), and black (K)) are to be respectively formed. The four photosensitive bodies can be arranged along a line. The toner images of the four colors (i.e., Y, M, C, and K) can be sequentially overlapped on the print medium (or to a transfer belt) to form the full color image while the print medium (or the belt) sequentially passes through the four photosensitive bodies. One of the advantages of the single-path type electro-photographic image forming apparatus is the relatively high printing speed.

The single-path type electro-photographic image forming apparatus can include, in addition to the four photosensitive bodies, a transferring unit having a belt and four transferring rollers disposed to oppose the four photosensitive bodies with the belt disposed therebetween.

As the belt passes between a transferring roller and a photosensitive body, the developer associated with one of the colors is transferred from the photosensitive body to the belt or directly to print medium (e.g., paper) transported by the belt. A full color image is formed when the developers for all four colors are transferred to the print medium in sequence as the belt sequentially passes between the four photosensitive bodies and their associated transfer rollers.

The transferring rollers are conventionally arranged such that their centers are aligned with respect to each other in order to allow the belt to be driven in such a manner that the belt stays relatively flat, and such that they press against the photosensitive bodies with even pressure.

As can be appreciated, an important consideration when forming a color image of multiple colors by overlapping images of individual colors is the alignments or the registration of the individual color images with respect to each other.

The color mis-registration, often referred to as the color registration error, can have an adverse impact on the image quality. It is thus desirable to reduce the color registration error for improving the quality of a final color image.

SUMMARY OF THE DISCLOSURE

According to an aspect of the present disclosure, a transfer unit for transferring developer images from a plurality of image carrying members of an image forming apparatus to a print medium may be provided to include a belt, a plurality of transferring rollers and a support unit. The belt may be configured to rotate in a loop. The plurality of transferring rollers may be disposed inside the loop to each contact the belt, and may include an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers. The support unit may be configured to support the plurality of transferring rollers such that the rotational axes of the upper and lower transferring rollers define a first plane, and such that the rotational axes of the one or more middle transferring rollers define a second plane substantially parallel to, but not coplanar with, the first plane.

The belt may comprise a transport belt configured to transport the print medium to the plurality of image carrying members. The belt may alternatively comprise an intermediate transfer belt onto which the developer images are transferred from the plurality of image carrying members.

The distance between the first plane and the second plane may be in the range from about 0.5 millimeters to 2 millimeters.

The distance between the first plane and the second plane may be about 1 millimeter.

The supporting unit may comprise a plurality of shaft supporting members to rotatably support shafts of the plurality of transferring rollers and a biasing unit to bias the plurality of shaft supporting members outwardly with respect to the loop of the belt.

The supporting unit may further comprise a frame to moveably support the shaft supporting members.

The biasing unit may exert biasing forces that satisfy (F_middle>F_end1) or (F_middle>F_end2). F_end1 may represent an upper biasing force applied to the upper transferring roller. F_middle may represent a middle biasing force constituting the largest force among bias forces applied to the one or more middle transferring rollers. F_end2 may represent a lower biasing force applied to the lower transferring roller.

The middle transferring roller may comprise a plurality of middle transferring rollers to each of which a substantially equal bias force is applied by the biasing unit.

The upper biasing force may be different from the lower biasing force.

The upper biasing force may be larger than the lower biasing force.

The biasing unit may comprise a plurality of elastic members configured to elastically bias the plurality of shaft supporting members outwardly with respect to the loop of the belt. The plurality of elastic members may satisfy (C_middle>C_end1) or (C_middle>C_end2). C_end1 may represent a coefficient of elasticity of an upper one of the plurality of elastic members corresponding to the upper transferring roller. C_middle may represent coefficients of elasticity of middle ones of the plurality of elastic members corresponding to the one or more middle transferring rollers. C_end2 may represent a coefficient of elasticity of a lower one of the plurality of elastic members corresponding to the lower transferring roller.

According to another aspect, a transfer unit for transferring developer images from a plurality of image carrying members of an image forming apparatus to a print medium may be provided to include a belt, a plurality of transferring rollers and a biasing unit. The belt may be configured to rotate in a loop. The plurality of transferring rollers may be disposed inside the loop to each contact the belt. The plurality of transferring rollers may include an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers. The biasing unit may be configured to bias the plurality of transferring rollers outwardly with respect to the loop of the belt. The biasing unit may satisfy (F_middle>F_end1) or (F_middle>F_end2). F_end1 may represent an upper biasing force applied to the upper transferring roller. F_middle may represent any one of biasing forces respectively applied to the one or more middle transferring rollers. F_end2 may represent a lower biasing force applied to the lower transferring roller.

The belt may comprise a transport belt configured to transport the print medium to the plurality of image carrying members. The belt may alternatively comprise an intermediate transfer belt onto which the developer images are transferred from the plurality of image carrying members.

Each of the one or more middle rollers may be applied substantially the same biasing force.

The upper biasing force may be different from the lower biasing force.

The upper biasing force may be larger than the lower biasing force.

According to yet another aspect, an image forming apparatus may be provided to include a plurality of image carrying bodies and a transferring unit. The plurality of image carrying bodies may each be configured carry a developer image. The transferring unit may comprise a belt, a plurality of transferring rollers and a support unit. The belt may be configured to rotate in a loop. The plurality of transferring rollers may each opposingly face a respective corresponding one of the plurality of image carrying bodies with the belt interposed therebetween. The plurality of transferring rollers may include an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers. The support unit may be configured to support the plurality of transferring rollers such that the rotational axes of the upper and lower transferring rollers define a first plane, and such that therotational axes of the one or more middle transferring rollers define a second plane substantially parallel to, but not coplanar with, the first plane.

The supporting unit may comprise a biasing unit that may be configured to bias the plurality of transferring rollers in a direction toward the plurality of image carrying bodies. The biasing unit may exert biasing forces that satisfy (F_middle>F_end1) or (F_middle>F_end2). F_end1 may represent an upper biasing force applied to the upper transferring roller. F_middle may represent a middle biasing force applied to the one or more middle transferring rollers. F_end2 may represent a lower biasing force applied to the lower transferring roller.

According to even yet another aspect, an image forming apparatus may be provided to include a plurality of image carrying bodies each configured carry a developer image and a transferring unit. The transferring unit may comprise a belt, a plurality of transferring rollers and a biasing unit. The belt may be configured to rotate in a loop. The plurality of transferring rollers may each opposingly face a respective corresponding one of the plurality of image carrying bodies with the belt interposed therebetween. The plurality of transferring rollers may include an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers. The biasing unit may be configured to bias the plurality of transferring rollers toward the plurality of image carrying bodies. The biasing unit may satisfy (F_middle>F_end1) or (F_middle>F_end2). F_end1 may represent an upper biasing force applied to the upper transferring roller. F_middle may represent any one of biasing forces respectively applied to the one or more middle transferring rollers. F_end2 may represent a lower biasing force applied to the lower transferring roller.

The biasing unit may comprise a plurality of elastic members configured to elastically bias the plurality of transferring rollers toward the plurality of image carrying bodies. The plurality of elastic members may satisfy (C_middle>C_end1) or (C_middle>C_end2). C_end1 may represent a coefficient of elasticity of an upper one of the plurality of elastic members corresponding to the upper transferring roller. C_middle may represent coefficients of elasticity of middle ones of the plurality of elastic members corresponding to the one or more middle transferring rollers. C_end2 may represent a coefficient of elasticity of a lower one of the plurality of elastic members corresponding to the lower transferring roller.

BRIEF DESCRIPTION OF THE DRAWINGS

Various aspects and features of the present disclosure will become apparent and more readily appreciated from the following description of several embodiments, taken in conjunction with the accompanying drawings, in which.

DETAILED DESCRIPTION OF SEVERAL EMBODIMENTS

Figure 1:
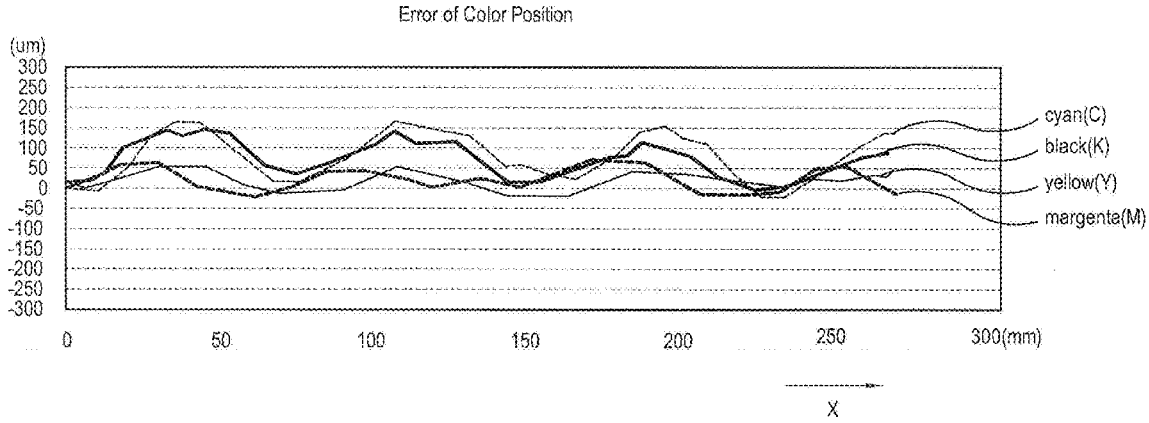
FIG. 1 shows test results of color registration in a conventional image forming apparatus.

Reference will now be made in detail to several embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should also be noted that in the drawings, the dimensions of the features are not intended to be to true scale and may be exaggerated for the sake of allowing greater understanding. Repetitive description with respect to like elements of different embodiments may be omitted for the sake of brevity.

Figure 2:
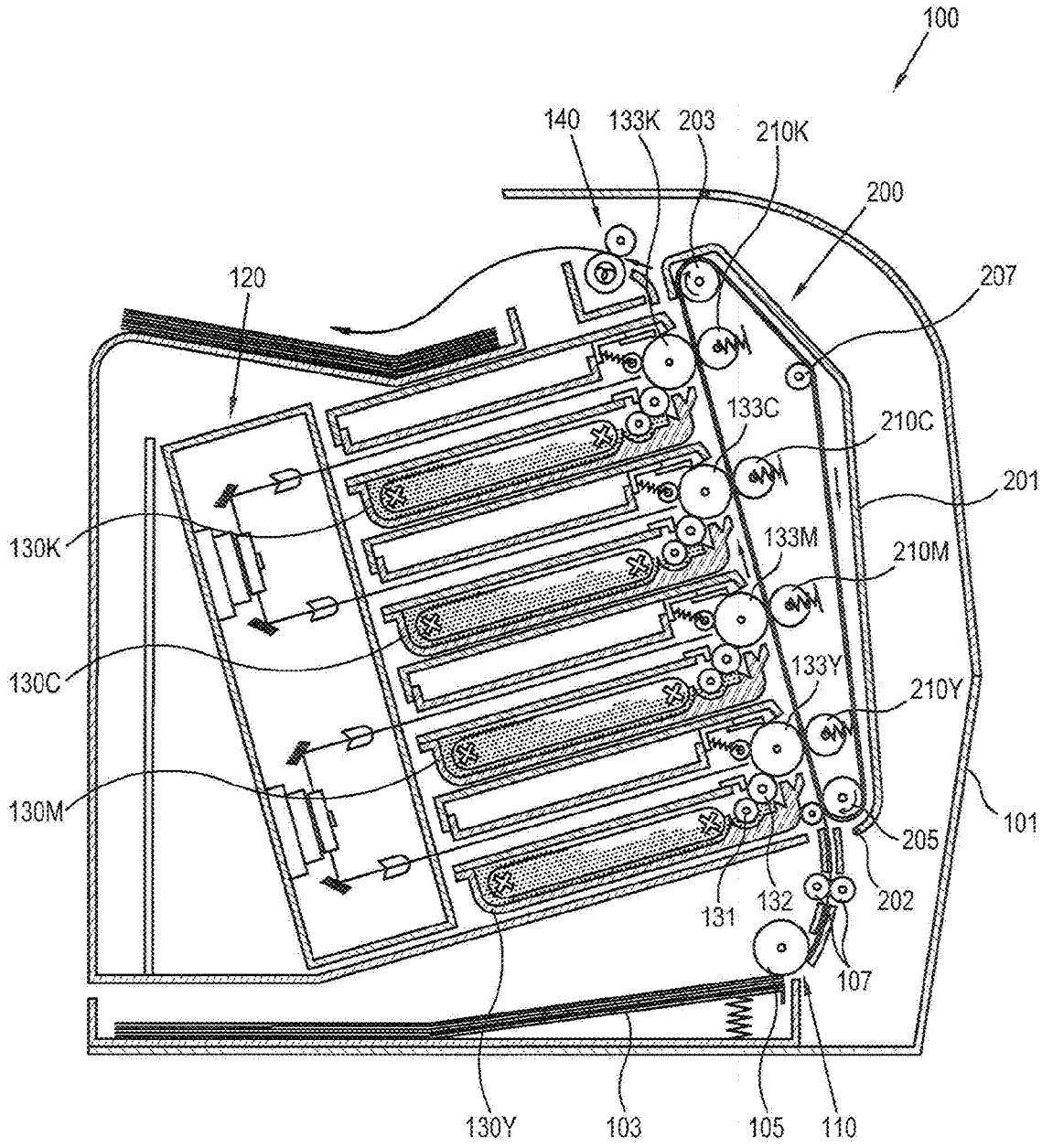
FIG. 2 is a schematic cross-section view of an image forming apparatus according to an embodiment of the present disclosure.

Referring to FIG. 2, an image forming apparatus 100 according to an embodiment of the present disclosure can include multiple image carrying bodies 133Y, 133M, 133C and 133K, on the surface of each a visual image can be formed with developer, a transferring unit 200 configured to transfer the visual image from the surfaces of the image carrying bodies 133Y, 133M, 133C and 133K to a print medium and a fixing unit 140 configured to fix the transferred visual image to the print medium.

The image carrying bodies 133Y, 133M, 133C and 133K can be accommodated in multiple developing cartridges 130Y, 130M, 130C and 130K, each of which may be configured to store developer of a particular color. In FIG. 2, the developing cartridges 130 can be sequentially arranged in the following order: Y, M, C and K. It should be noted however that the developing cartridges 130 can alternatively be arranged in different sequential order from that shown in FIG. 2. For example, the developing cartridges 130 can be arranged in the following order: C, M, Y and K. The arrangement of the developing cartridges 130 shown in FIG. 2 is only by way of example.

The developing cartridges 130Y, 130M, 130C and 130K can store the developers corresponding to yellow (Y), magenta (M), cyan (C) and black (K), respectively, and can be detachably provided in a main body 101 of the image forming apparatus 100. According to an embodiment, the transferring unit 200 can be disposed to pivot about a hinge shaft 202 so as to be capable of being moved out of the way to allow the removal or installation of the detachably mounted developing cartridges 130Y, 130M, 130C and 130K.

The yellow developing cartridge 130Y can include a developing roller 132 configured to develop an electrostatic latent image formed on the image carrying body 133Y with yellow developer. The feeding roller 131 may be configured to feed the developing roller 132 with the yellow developer. Such a structure for the developing cartridge 130Y can also be used with the other developing cartridges 130M, 130C and 130K. It should be understood however that the above described configuration is but only one example, and that various other structures and configurations can be applied to the developing cartridges 130Y, 130M, 130C and 130K.

As shown in FIG. 2, the image forming apparatus 100 can include an exposure unit 120 configured to form the electrostatic latent image by exposing with light the surface of each of the image carrying bodies 133Y, 133M, 133C and 133K. In some embodiments however, the exposure unit 120 may be omitted, for example, when each of the image carrying bodies 133Y, 133M, 133C and 133K constitute an imaging drum rather than a photosensitive body. In such an embodiment, the imaging drum can be provided with multiple electrodes on the periphery thereof to selectively apply an electric current so that a latent image can be formed on the periphery without requiring a light exposure. As such an imaging drum is generally known, a detailed description thereof is not necessary.

The exposure unit 120 can receive, from a controller (not shown), for example, an exposure signal corresponding to image data to be printed, and can expose the surface of each of the image carrying bodies 133Y, 133M, 133C and 133K in accordance with the received exposure signal.

Referring again to FIG. 2, the image forming apparatus 100 according to an embodiment of the present disclosure can further include a feeding unit 110 configured to feed printing medium to the transferring unit 200.

In the feeding unit 110, the print medium loaded on a knock-up plate 103 can be picked up by a pick-up roller 105. The picked-up print medium can subsequently be supplied to feed printing medium to the transferring unit 200.

The transferring unit 200 can be configured to transport the print medium so that the print medium fed by the feeding unit 110 can pass through each of the multiple developing cartridges 130Y, 130M, 130C and 130K. Thus, each image formed of the yellow (Y), magenta (M), cyan (C) and black (K) developer can be sequentially applied in an overlapping manner onto the print medium to form a full color visible image. The color image can be fixed to the print medium by heat and pressure from the fixing unit 140.

Figure 3:
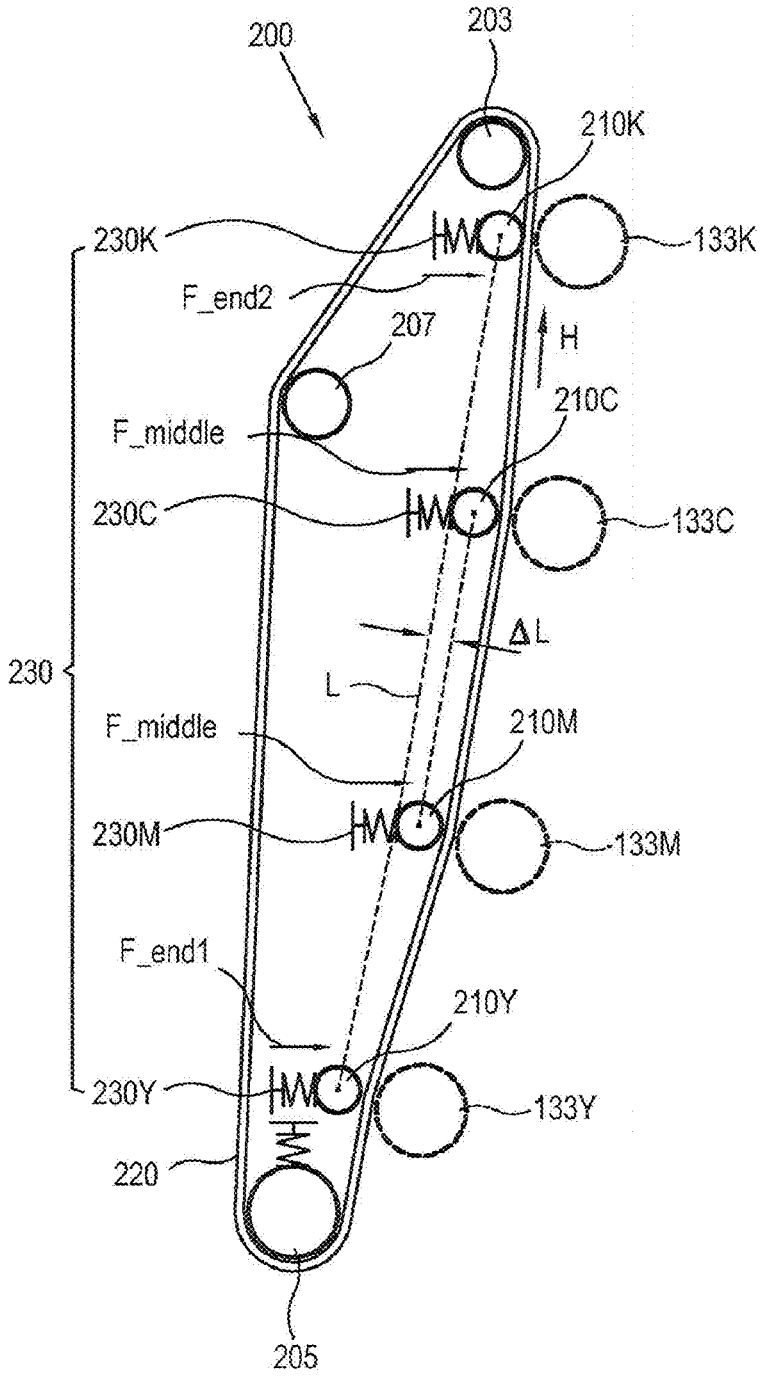
FIG. 3 is a schematic view of a transferring unit according to an embodiment that may be employed in the image forming apparatus of FIG. 2.

As shown in FIGS. 2 and 3, the transferring unit 200 can include a transporting belt 220 configured to transport the print medium so that the print medium passes sequentially through the image carrying bodies 133Y, 133M, 133C and 133K. The transferring unit 200 can include driving rollers 203, 205 and 207 configured to rotationally drive the transporting belt 220. The transferring unit 200 can include multiple transferring rollers 210Y, 210M, 210C and 210K disposed to oppose respective corresponding one of the image carrying bodies 133Y, 133M, 133C and 133K with the transporting belt 220 interposed therebetween. The transferring unit 200 can include a biasing unit 230 configured to bias the transferring rollers 210Y, 210M, 210C and 210K in a direction of the corresponding one of the multiple image carrying bodies 133Y, 133M, 133C and 133K. The transferring unit 200 can include a unit frame 201 configured to support the transporting belt 220, the transferring rollers 210Y, 210M, 210C and 210K and the biasing unit 230.

The image carrying bodies 133Y, 133M, 133C and 133K are illustrated for reference in FIG. 3 to describe a direction of a biasing force from the biasing unit 230.

With respect to a transporting direction H of the transporting belt 220, the transferring rollers 210Y, 210M, 210C and 210K can be organized into an upper transferring roller 210Y, middle transferring rollers 210M and 210C, and a lower transferring roller 210K. In some embodiments, for example, when the only three color developers (e.g., Y, M, and C) are used, only one of the foregoing middle transferring rollers 210M and 210C may be provided.

The biasing unit 230 can be configured to bias the transferring rollers 210Y, 210M, 210C and 210K toward the associated one of the multiple image carrying bodies 133Y, 133M, 133C and 133K in such a manner that the following alternative expression is satisfied:

$$(F_middle > F_end1) \text{ or } (F_middle > F_end2) \qquad \text{(Expression 1).}$$

In the above Expression 1, F_end1 represents the biasing force used to bias the upper transferring roller 210Y toward the image carrying body 133Y, F_middle represents the biasing force used to bias each of the middle transferring rollers 210M and 210C toward the corresponding image carrying bodies 133M and 133C, respectively, and F_end2 represents the biasing force used to bias the lower transferring roller 210K toward the image carrying body 133K.

When both of middle transferring rollers 210M and 210C are provided, the middle transferring rollers 210M and 210C can receive substantially the same biasing force. Alternatively, different biasing forces can be applied to the middle transferring rollers 210M and 210C as long as Expression 1 above is satisfied.

When compared to the force used to bias the upper transferring roller 210Y and the lower transferring roller 210K disposed respectively at each end of the transferring unit 200, the force used to bias the middle transferring rollers 210M and 210C toward the image carrying bodies 133M and 133C, respectively, can be a relatively larger biasing force. Thus, as shown in FIG. 3, the transporting belt 220 can protrude (e.g., bulge out) at the middle portion corresponding to the middle transferring rollers 210M and 210C when in a sub-assembly state before the transferring unit 200 is coupled to the image forming apparatus 100. That is, a line connecting the rotation centers of the middle transferring rollers 210M and 210C can deviate toward the image carrying bodies 133M and 133C by a distance ΔL from a line L connecting the rotation centers of the upper and lower transferring rollers 210Y and 210K.

As shown in FIG. 2, when the transferring unit 200 of which the middle portion protrudes in the sub-assembly state is coupled to the main body 101 of the image forming apparatus 100, the transporting belt 220 becomes substantially flat. This is because each of the transferring rollers 210Y, 210M, 210C and 210K come into a pressed relationship with the respective associated one of the multiple image carrying bodies 133Y, 133M, 133C and 133K with the transporting belt 220 therebetween, and because the developing cartridges 130 are disposed in such a position that the rotational axis of each of the image carrying bodies 133 can be aligned. Because of the pressing force between the middle transferring rollers 210M and 210C and their corresponding image carrying bodies 133M and 133C at least as a result of the biasing force provided by the biasing unit 230, the middle portion of the transporting belt 220 in the transferring unit 200 can be changed from a protruded configuration (see FIG. 3) to a substantially flat configuration (see FIG. 2) when installed in the image forming apparatus 100.

The biasing unit 230 can include multiple elastic members (e.g., springs) 230Y, 230M, 230C and 230K, each of which may be configured to elastically bias the respective associated one of the transferring rollers 210Y, 210M, 210C and 210K. In some embodiments, the biasing unit 230 need not include the elastic members 230Y, 230M, 230C and 230K to provide the biasing force. For example, the biasing force can be provided by air pressure, oil pressure, and/or electromagnetic force, for example, instead of by an elastic member.

The coefficient of elasticity of each of the elastic members 230Y, 230M, 230C and 230K can be such that the following expression is satisfied to obtain the biasing forces consistent with Expression 1 above:

$$(C_middle > C_end1) \text{ or } (C_middle > C_end2) \qquad \text{(Expression 2)},$$

where, C_end1 represents the coefficient of elasticity of the elastic member 230Y for elastically biasing the upper transferring roller 210Y, C_middle represents the coefficient of elasticity of each the elastic members 230M and 230C for elastically biasing the middle transferring rollers 210M and 210C, respectively, and C_end2 represents the coefficient of elasticity of the elastic member 230K for elastically biasing the lower transferring roller 210K.

Figure 4:
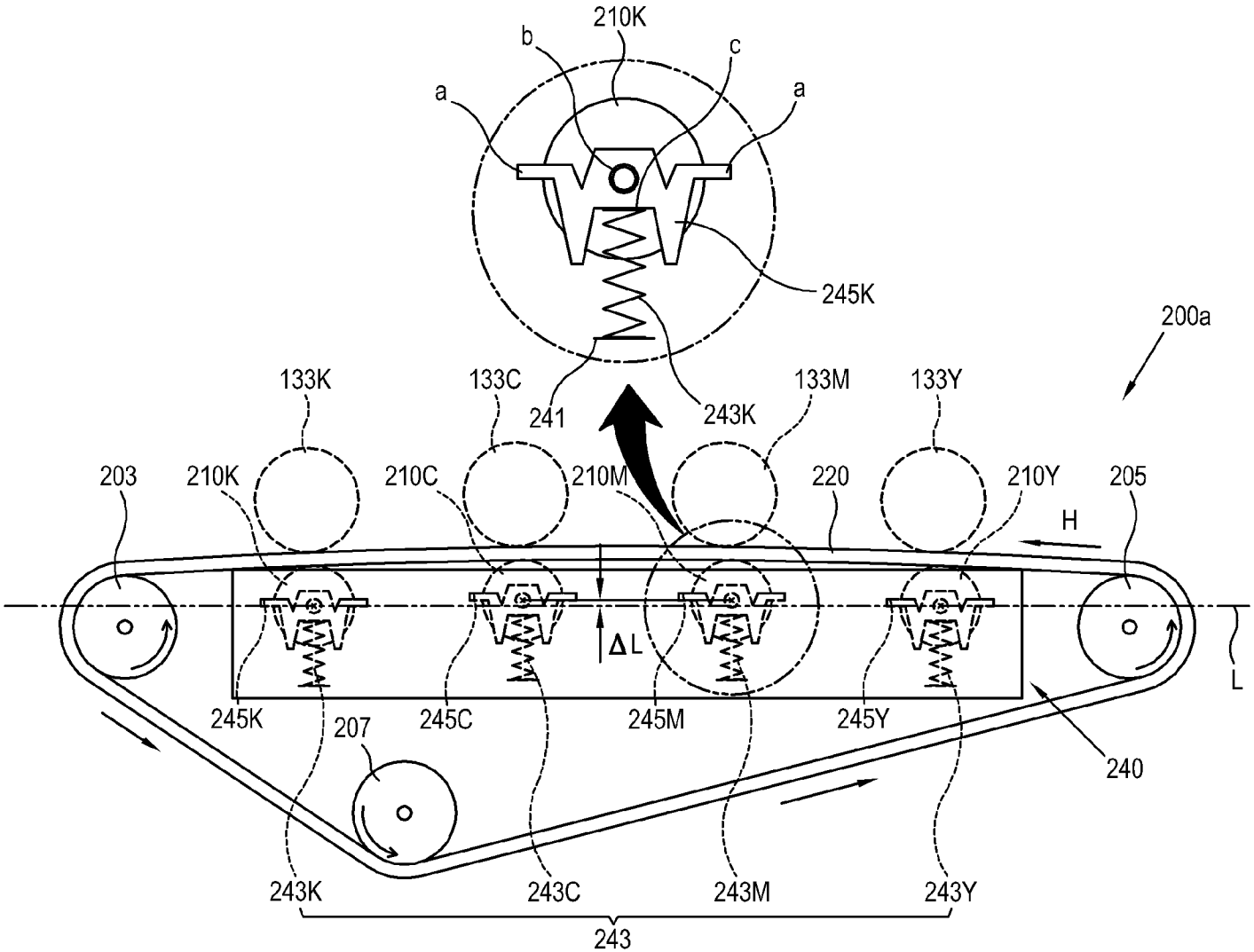
FIG. 4 is a schematic view of a transferring unit according to another embodiment.
Figure 5:
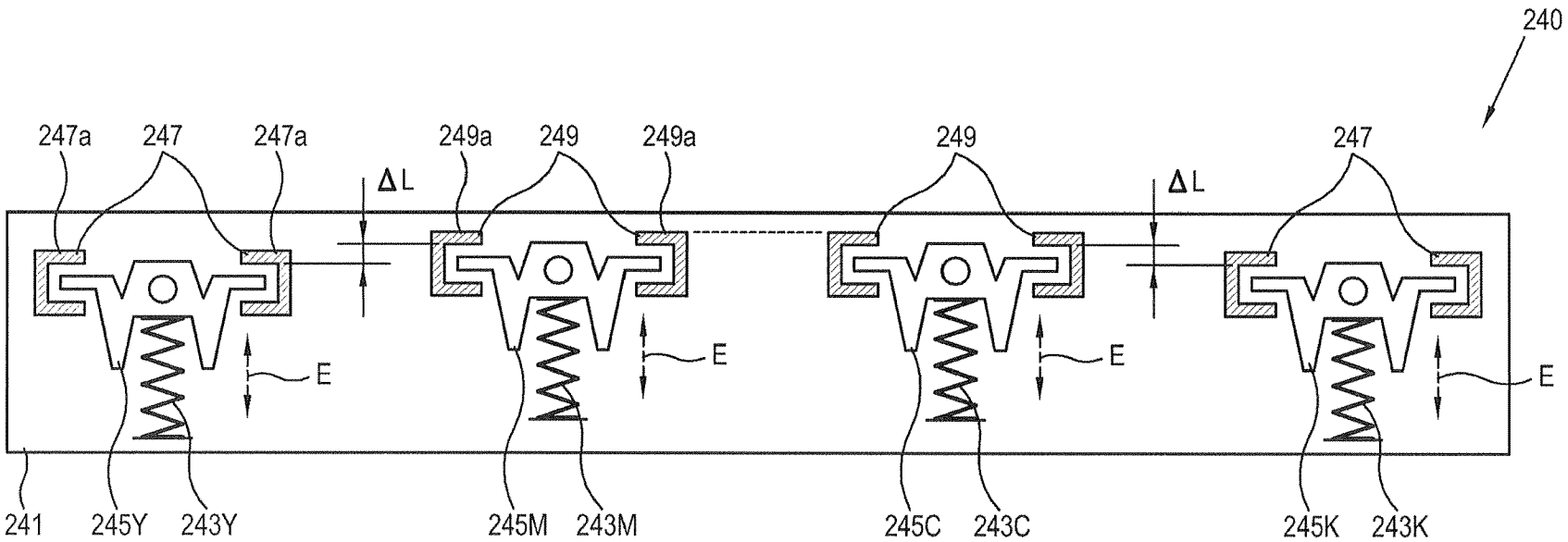
FIG. 5 is a partial enlarged view of a supporter that supports the transferring rollers of the transferring unit of FIG. 4.

According to alternative embodiments, the image forming apparatus 100 can include a transferring unit 200*a* according to another embodiment shown in FIGS. 4 and 5 instead of the transferring unit 200 described above.

According to the embodiment shown in FIGS. 4 and 5, the transferring unit 200*a* can include the transporting belt 220 configured to transport a print medium fed from the feeding unit 110 toward the multiple image carrying bodies 133Y, 133M, 133C and 133K, the driving rollers 203, 205 and 207 configured to rotationally drive the transporting belt 220, the transferring rollers 210Y, 210M, 210C and 210K disposed to oppose to their respective associated image carrying bodies 133Y, 133M, 133C and 133K with the transporting belt 220 being interposed therebetween and a supporting unit 240 configured to support the multiple transferring rollers 210Y, 210M, 210C and 210K.

With respect to the transporting direction H of the transporting belt 220, the transferring rollers 210Y, 210M, 210C and 210K can be organized into the upper transferring roller 210Y, the middle transferring rollers 210M and 210C, and the lower transferring roller 210K.

As shown in FIG. 4, the supporting unit 240 can be configured to support the transferring rollers 210Y, 210M, 210C and 210K so that the rotational centers of the middle transferring rollers 210M and 210C can be deviated from the line L connecting the rotational centers of the upper and lower transferring rollers 210Y and 210K toward the image carrying bodies 133Y, 133M, 133C and 133K, that is, the rotational centers of the middle transferring rollers 210M and 210C can be deviated from the line L in an outward direction of the transporting belt 220.

In one example, the deviation ΔL of the rotational center of the middle transferring rollers 210M and 210C from the line L can range from about 0.5 millimeters to about 2 millimeters.

As shown in FIG. 4, the supporting unit 240 can include multiple shaft supporting members 245Y, 245M, 245C and 245K, each of which may be configured to rotatably support the shafts of the respective associated one of the transferring rollers 210Y, 210M, 210C and 210K. The supporting unit 240 can include a biasing unit 243 configured to bias the shaft supporting members 245Y, 245M, 245C and 245K in the direction of the image carrying bodies 133Y, 133M, 133C and 133K.

The biasing unit 243 includes a plurality of elastic members 243Y, 243M, 243C and 243K to elastically bias the plurality of shaft supporting members 245Y, 245M, 245C and 245K, respectively.

In some embodiments, the biasing unit 243 can be substantially the same as the biasing unit 230 described above. That is, the biasing unit 243 can be configured to bias the transferring rollers 210Y, 210M, 210C and 210K toward the corresponding image carrying bodies 133Y, 133M, 133C and 133K to satisfy Expression 1 above. In other embodiments, however, the biasing forces produced by the biasing unit 243 for biasing the transferring rollers 210Y, 210M, 210C and 210K may not satisfy Expression 1 above.

Like the elastic members 230Y, 230M, 230C and 230K described above, the elastic members 243Y, 243M, 243C and 243K shown in FIGS. 4 and 5 can have coefficients of elasticity such that Expression 2 above is satisfied.

In some embodiments, the shaft supporting members 245Y, 245M, 245C and 245K can have the same shape. The shape of shaft supporting member 245K is representatively described below.

The shaft supporting member 245K can includes a shaft inserting portion "b" in which the shaft of the transferring roller 210K is inserted, opposite end portions "a" configured to be supported by a frame 241 (to be described below), and a contact portion "c" configured to come in contact with one end of the elastic member 243K.

The supporting unit 240 can further include the frame 241 configured to support the shaft supporting members 245Y, 245M, 245C and 245K so that the shaft supporting members 245Y, 245M, 245C and 245K can move toward the image carrying bodies 133Y, 133M, 133C and 133K.

As shown in FIG. 5, the frame 241 can include a first guide groove 247 associated with the shaft supporting members 245K and 245Y and the elastic member 243K and 243Y, and a second guide groove 249 associated with the shaft supporting members 245M and 245C and the elastic member 243M and 243C.

Both end portions "a" of the shaft supporting members 245Y and 245K supporting the shafts of the upper transferring roller 210Y and the lower transferring roller 210K can be inserted in the first guide groove 247. The shaft supporting members 245Y and 245K can be moved along a direction E toward the image carrying bodies 133Y, 133M, 133C and 133K.

Both the end portions "a" of the shaft supporting members 245M and 245C supporting the shafts of the middle transferring rollers 210M and 210C can be inserted in the second guide groove 249. The shaft supporting members 245M and 245C can be moved along a direction E toward the image carrying bodies 133Y, 133M, 133C and 133K.

The first guide groove 247 can be provided with a first position restrictive piece 247*a* configured to prevent the shaft supporting members 245Y and 245K from separating from the elastic members 243Y and 243K, respectively, in the direction E toward the image carrying bodies 133Y and 133K. Likewise, the second guide groove 249 can be provided with a second position restrictive piece 249*a* configured to prevent the shaft supporting members 245M and 245C from separating in the direction E toward the image carrying bodies 133M and 133C.

Referring to FIG. 5, the second position restrictive piece 249*a* can be deviated or offset by a distance ΔL from the first position restrictive piece 247*a* in the direction E toward the image carrying bodies 133Y, 133M, 133C and 133K. As a result, the middle transferring rollers 210M and 210C can be deviated of offset by a distance ΔL from the line connecting the rotation centers of the upper transferring roller 210Y and the lower transferring roller 210K in the direction E toward the image carrying bodies. In some embodiments, the position restrictive pieces 247*a* and 249*a* of the guide grooves 247 and 249 can be used to offset or move the middle transferring rollers 210M and 210C from the upper transferring roller 210Y and the lower transferring roller 210K. In other embodiments, however, the above-described deviation can be achieved by other methods such as, for example, design change and substitution.

Thus, the transferring unit 200*a* can protrude at a middle portion of the transporting belt 220 corresponding to the middle transferring rollers 210M and 210C before being coupled to the image forming apparatus 100. When the transferring unit 200*a* is coupled to the image forming apparatus 100, the transporting belt 220 in the transferring unit 200*a* can be changed from a protruded configuration (see FIG. 4) to a substantially flat configuration (see FIG. 2).

Table 1 below shows examples of test results obtained by changing the deviation ΔL and the coefficients of elasticity of elastic the members 243Y, 243M, 243C and 243K.

TABLE 1

| Test | C_y | C_m | C_c | C_k | ΔL | 1P | 1 of 3 | 2 of 3 | 3 of 3 | AVR |
|---|---|---|---|---|---|---|---|---|---|---|
| Conventional Case | 1 | 1 | 1 | 1 | 0 | 130 | 154 | 161 | 182 | 157 |
| Case 1 | 1 | 1 | 1 | 1 | 1 | 136 | 120 | 105 | 95 | 114 |
| Case 2a | 1 | 1 | 1 | 1 | 2 | 149 | 149 | 105 | 104 | 127 |
| Case 2b | 1 | 2 | 2 | 0.5 | 2 | 125 | 123 | 127 | 116 | 123 |
| Case 2c | 1 | 2 | 2 | 1 | 2 | 148 | 166 | 141 | 123 | 145 |
| Case 2d | 1 | 2 | 2 | 1.5 | 2 | 110 | 97 | 124 | 124 | 114 |
| Case 2e | 0.5 | 2 | 2 | 1 | 2 | 119 | 127 | 157 | 157 | 140 |
| Case 2f | 1 | 1.5 | 1.5 | 0.5 | 2 | 125 | 114 | 133 | 119 | 123 |
| Case 2g | 1.5 | 1.5 | 1.5 | 0.5 | 2 | 133 | 117 | 91 | 130 | 118 |
| Case 3a | 1.5 | 1.5 | 1.5 | 0.5 | 1 | 138 | 111 | 108 | 113 | 118 |
| Case 3b | 1 | 1.5 | 1.5 | 0.5 | 1 | 103 | 76 | 97 | 70 | 87 |
| Case 3c | 1 | 1.5 | 1.5 | 1.5 | 1 | 102 | 100 | 85 | 105 | 98 |
| Case 3d | 1 | 1.5 | 1.5 | 1 | 1 | 103 | 129 | 135 | 132 | 125 |
| Case 3e | 1 | 2 | 2 | 0.5 | 1 | 129 | 126 | 117 | 164 | 134 |
| Case 3f | 1 | 2 | 2 | 1.5 | 1 | 86 | 107 | 97 | 92 | 96 |

In Table 1, the column headings "C_y," "C_m," "C_c" and "C_k" refer to the coefficients of elasticity for the elastic members 243Y, 243M, 243C and 243K, respectively. A number "1" refers to a force of 0.0246 kilograms of force per millimeter (kgf/mm) and a number "1.5" refers to a force that is 1.5 times 0.0246 kgf/mm (i.e., 1.5 times greater than "1").

The column heading "ΔL" refers to the amount or distance of the deviation in millimeters (mm). The column heading "1P" indicates a color registration error in micrometers (μm) when only one page is printed for the test. As previously stated, a color registration error refers to an error between developer dots which are the farthest away from each other when the developer dots of four colors (e.g., Y, M, C and K) are printed at one position. The color registration error can be an important factor that affects the quality of a color image in color printing. The smaller the color registration error, the better the quality of a color image results.

Also in Table 1, the column headings "1 of 3," "2 of 3," and "3 of 3" indicate the color registration errors in micrometers (μm) of the first page, the second page, and the third page, respectively, when test patterns of three pages are successively printed.

Moreover in Table 1, the column heading "AVR" refers to an average of the color registration errors of columns "1P," "1 of 3," "2 of 3" and "3 of 3."

The row heading "Conventional case" shows the deviation ΔL of the transferring unit and the coefficient of elasticity of the elastic member in a conventional image forming apparatus. In the "Conventional case," the deviation ΔL is typically zero and the coefficient of elasticity for every elastic member is the same (e.g., "1"). As shown in Table 1, the color registration errors in the "Conventional case" can be 130, 154, 161 182, and 157 μm for "1P," "1 of 3," "2 of 3," "3 of 3," and "AVR," respectively.

The color registration error test results in the row headings case 1, cases 2*a* to 2*g*, and cases 3*a* to 3*f*, can be improved from those of the "Conventional case" by giving the deviation ΔL or changing the coefficient of elasticity of the elastic members 243Y, 243M, 243C and 243K to satisfy Expression 2 above. Thus, it will be appreciated that the value of "AVR" can be improved as a result of total tests of case 1, cases 2*a* to 2*g* and cases 3*a* to 3*f* when compared to the Conventional case.

The case 1 was tested with the coefficients of elasticity for the elastic members 243Y, 243M, 243C and 243K set to 1 under the condition that the deviation ΔL is set at 1 mm.

The cases 2*a* to 2*g* were tested with respect to varying coefficients of elasticity for the elastic members 243Y, 243M, 243C and 243K as shown in Table 1 under the condition that the deviation ΔL is set at 2 mm.

The cases 3*a* to 3*f* were tested with respect to varying coefficients of elasticity for the elastic members 243Y, 243M, 243C, and 243K as shown in Table 1 under the condition that the deviation ΔL is set at 1 mm.

As shown in Table 1, the color registration error in the cases when the deviation ΔL is set to 1 mm can be smaller than the color registration errors in the cases when the deviation ΔL is set to 2 mm.

In particular, the case 3*b* is shown to have the smallest "AVR", with a value of about 87 micrometers, from among the tested cases.

For the purpose of a comparative illustration, the test results of color registration for a conventional image forming apparatus is plotted as depicted in FIG. 1, which indicate that after applying developers corresponding to Y, M, C and K colors to a print medium according to test patterns designed for a A4 sized paper, the deviation, i.e., registration error, can occur between the target or the intended position on the printing medium to which each color developer is to be applied and the position where each developer is actually applied with respect to a transporting direction X of the A4 paper.

That is, as shown in FIG. 1, the developers for black (K) and cyan (C) show registration errors having a periodic pattern within a range of about 20 microns to about 180 microns along the transporting direction X of the A4 paper while the developers for yellow (Y) and magenta (M) show registration errors having a periodic error pattern that fluctuates within a range of about −30 microns to about 70 microns.

Thus, in the above illustrative test of conventional image forming apparatus, the color registration error, that is, the misalignment or mis-registration between the positions of developer of one color and another developer of a different color, can have a maximum value of about 180 microns.

Figure 6:
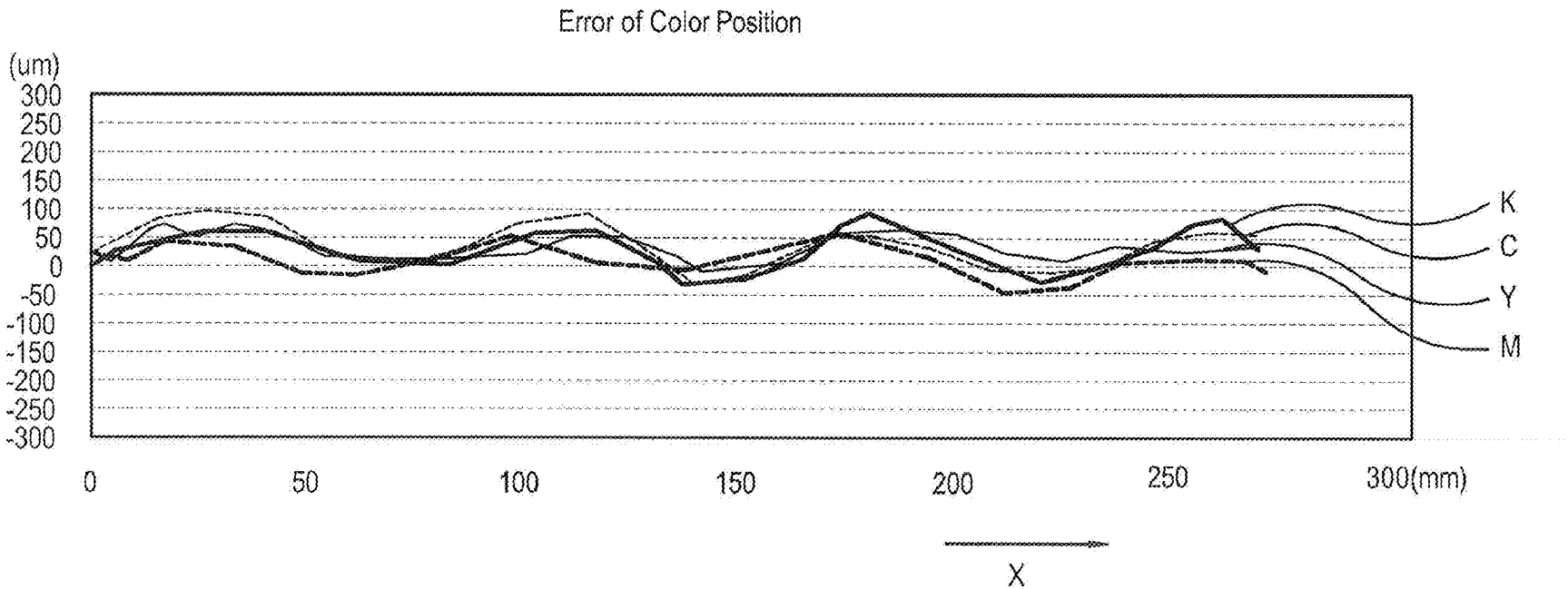
FIG. 6 shows test results of color registration in the image forming apparatus of FIG. 2.

For a comparison, FIG. 6 shows the test result for the case 3*b* in Table 1 being in a pattern graph similar to the pattern graph of FIG. 1.

Comparing the results in FIG. 6 with the results in FIG. 1, FIG. 6 shows that a peak value of the position error between respective colors (e.g., Y, M, C and K) is about 100 μm, while FIG. 1 shows that a peak value of about 180 μm. Thus, it will be appreciated that the results associated with case 3*b* are enhanced by about 45% when compared with the results of a conventional case (i.e., the results shown in FIG. 1).

In addition, while the position error between black (K) and cyan (C) and the position error between magenta (M) and yellow (Y) can be different in a pattern along the transporting direction X of the print medium in FIG. 1, the position errors between the colors (i.e., Y, M, C, and K) can have a substantially similar pattern in FIG. 6. In FIG. 6, it is at least possible to visually distinguish the position error between magenta (M) and yellow (Y), but the position error between black (K) and cyan (C) is hardly visible they substantially overlap each other. Thus, it will be appreciated that the position error results between the various colors shown in FIG. 6 can be an improvement over the results shown in the pattern of FIG. 1.

Table 2 below shows a comparison of the linear velocity of the transporting belt between a conventional image forming apparatus A and an image forming apparatus B configured according to case 3*b* described above in Table 1.

TABLE 2

| | A | B |
|---|---|---|
| Average velocity | 204.19 mm/sec | 204.14 mm/sec |
| Maximum velocity deviation in each section | 0.05 mm/sec | 0.03 mm/sec |
| Maximum velocity deviation | 0.11 mm/sec | 0.06 mm/sec |

Referring to Table 2, the maximum velocity deviation in the linear velocity of the transporting belt 220 decreases from 0.11 millimeters-per-second (mm/sec) to 0.06 mm/sec, a reduction of about 45 percent, thereby enhancing the consistency in the speed of the transporting belt 220.

When the maximum velocity deviation is converted into a corresponding color registration error at a front end portion of the print medium, the conventional image forming apparatus A has a color registration error of 87 μm, but the color registration error according to the image forming apparatus B is 48 μm. Thus, the image forming apparatus B can provide an improvement in color registration error of about 40 μm. For example, when one sheet of A4 size, which has a length of about 297 mm, is transported along the transporting belt 220, the image forming apparatus B can provide an improved color registration by as much as about two dots.

Figure 7:
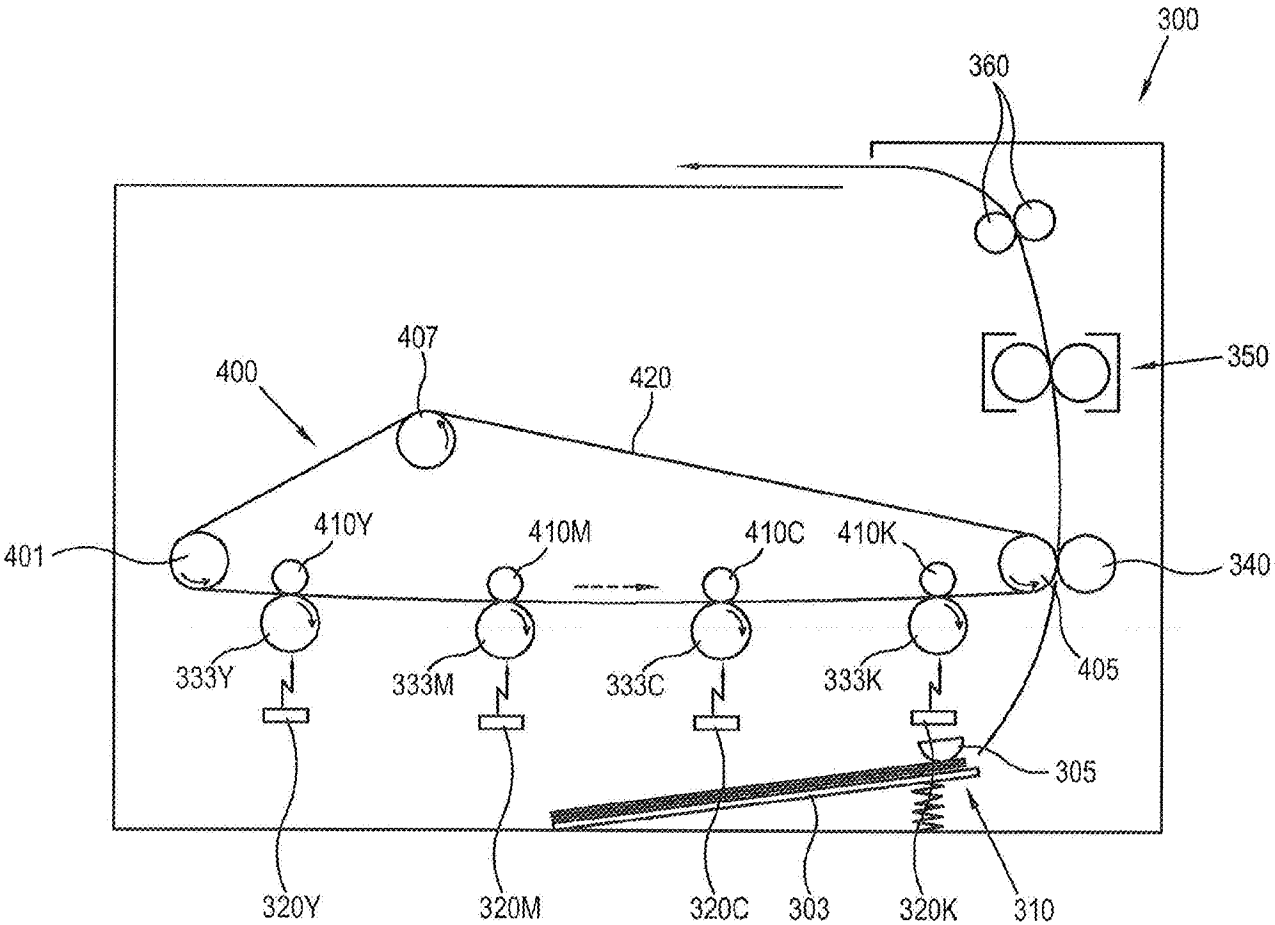
FIG. 7 is a schematic cross-section view of an image forming apparatus according to another embodiment of the present disclosure.

Referring to FIG. 7, an image forming apparatus 300 according to another embodiment of the present disclosure can include a feeding unit 310, multiple image carrying bodies 333Y, 333M, 333C and 333K, multiple exposure units 320Y, 320M, 320C and 320K, an intermediate transferring unit 400, a final transferring unit 340, a fixing unit 350 and a discharging unit 360.

The feeding unit 310 can include a pick-up roller 305 configured to pick up the print medium loaded on a knock-up plate 303.

The exposure units 320Y, 320M, 320C and 320K are configured to expose the image carrying bodies 333Y, 333M, 333C and 333K, respectively, corresponding to the images to be printed. Accordingly, in the surfaces of the image carrying bodies 333Y, 333M, 333C and 333K can formed, respectively, a yellow latent image to which a yellow developer is applied, a magenta latent image to which a magenta developer is applied, a cyan latent image to which a cyan developer is applied and a black latent image to which a black developer is applied.

The multiple latent images can be developed by using developers (i.e., toners) of corresponding colors through developing rollers (not shown).

As shown in FIG. 7, the transferring unit 400 according to an embodiment of the present disclosure can include an intermediate transferring belt 420, driving rollers 401, 405 and 407 configured to rotationally drive the intermediate transferring belt 420 and multiple transferring rollers 410Y, 410M, 410C and 410K disposed to oppose the image carrying bodies 333Y, 333M, 333C and 333K with the intermediate transferring belt 420 interposed therebetween.

The transferring unit 400 can include a biasing unit (not shown) to bias each of the transferring rollers 410Y, 410M, 410C and 410K toward the respective corresponding one of the image carrying bodies 333Y, 333M, 333C and 333K. The biasing unit (not shown) can be the same as the biasing unit 230 described above, for example, and thus repetitive descriptions thereof is not necessary.

In some embodiments, the transferring unit 400 can include a supporting unit 240 as described above with respect to FIGS. 4 and 5. The supporting unit 240 can be configured to support the transferring rollers 410Y, 410M, 410C and 410K so that the rotational centers of the middle transferring rollers 410M and 410C can deviate or be offset from a line connecting the rotational centers of the upper transferring rollers 410Y and the lower transferring rollers 410K in a direction of the image carrying bodies 333Y, 333M, 333C and 333K, that is, toward the outside of the intermediate transferring belt 420 with respect to the moving direction of the intermediate transferring belt 420. A middle portion of the intermediate transferring belt 420 can protrude by the deviation corresponding to the middle transferring rollers 410M and 410C in a sub-assembly state, that is, before being coupled to the image forming apparatus 300. The middle portion cab become substantially flat as described above by the positions of the image carrying bodies 333Y, 333M, 333C and 333K when coupled to the image forming apparatus 300. As shown in FIG. 7, the intermediate transferring belt 420 can come into contact with the image carrying bodies 333Y, 333M, 333C and 333K and can become substantially flat in the transferring region.

The transferring units 200 and 200*a* described above use the transporting belt 220 for transporting the print medium. The transferring unit 400, however, uses the intermediate transferring belt 420 as an intermediate transfer belt to which the individual color images from the image carrying bodies 333Y, 333M, 333C and 333K are transferred.

The transferring rollers 410Y, 410M, 410C and 410K assist in the transfer of the yellow, magenta, cyan, and black developers from the image carrying bodies 333Y, 333M, 333C and 333K to the intermediate transferring belt 420, thus forming a color image on the surface of the intermediate transferring belt 420.

The final transferring unit 340 can transfer the color image from the intermediate transferring belt 420 to the print medium fed from the feeding unit 310.

So formed color image can be fixed to the print medium by heat and pressure while the printing medium passes through the fixing unit 350.

The print medium bearing the fixed color image can then be discharged outside of the image forming apparatus 300 by the discharging unit 360.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A transfer unit for transferring developer images from a plurality of image carrying members of an image forming apparatus to a print medium, comprising:

a belt configured to rotate in a loop;

a plurality of transferring rollers disposed inside the loop to each contact the belt, the plurality of transferring rollers including an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers; and a support unit configured to support the plurality of transferring rollers such that rotational axes of the upper and lower transferring rollers define a first plane, and such that rotational axes of the one or more middle transferring rollers define a second plane substantially parallel to, but not coplanar with, the first plane, wherein a distance between the first plane and the second plane is in a range from about 0.5 millimeters to 2 millimeters.

2. A transfer unit for transferring developer images from a plurality of image carrying members of an image forming apparatus to a print medium, comprising:

a belt configured to rotate in a loop;

a plurality of transferring rollers disposed inside the loop to each contact the belt, the plurality of transferring rollers including an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers; and a support unit configured to support the plurality of transferring rollers such that rotational axes of the upper and lower transferring rollers define a first plane, and such that rotational axes of the one or more middle transferring rollers define a second plane substantially parallel to, but not coplanar with, the first plane, wherein a distance between the first plane and the second plane is about 1 millimeter.

3. A transfer unit for transferring developer images from a plurality of image carrying members of an image forming apparatus to a print medium, comprising:

a belt configured to rotate in a loop;

a plurality of transferring rollers disposed inside the loop to each contact the belt, the plurality of transferring rollers including an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers; and a support unit configured to support the plurality of transferring rollers such that rotational axes of the upper and lower transferring rollers define a first plane, and such that rotational axes of the one or more middle transferring rollers define a second plane substantially parallel to, but not coplanar with, the first plane, wherein the supporting unit comprises:

a plurality of shaft supporting members to rotatably support shafts of the plurality of transferring rollers; and a biasing unit to bias the plurality of shaft supporting members outwardly with respect to the loop of the belt, wherein the biasing unit exerts biasing forces that satisfy:

(F_middle>F_end1) or (F_middle>F_end2), wherein F_end1 represents an upper biasing force applied to the upper transferring roller; F_middle representing a middle biasing force constituting the largest force among bias forces applied to the one or more middle transferring rollers; F_end2 representing a lower biasing force applied to the lower transferring roller.

4. The transferring unit according to claim 3, wherein the middle transferring roller comprises a plurality of middle transferring rollers to each of which a substantially equal bias force is applied by the biasing unit.

5. The transfer unit according to claim 3, wherein the upper biasing force is different from the lower biasing force.

6. The transfer unit according to claim 5, wherein the upper biasing force is larger than the lower biasing force.

7. A transfer unit for transferring developer images from a plurality of image carrying members of an image forming apparatus to a print medium, comprising:

a belt configured to rotate in a loop;

a plurality of transferring rollers disposed inside the loop to each contact the belt, the plurality of transferring rollers including an upper transferring roller positioned at an upstream end of the belt with respect to a rotational direction of the belt a lower transferring roller positioned at a downstream end opposite to the upstream end of the belt with respect to the rotational direction of the belt and one or more middle transferring rollers positioned between the upper and lower transferring rollers; and a support unit configured to support the plurality of transferring rollers such that rotational axes of the upper and lower transferring rollers define a first plane, and such that rotational axes of the one or more middle transferring rollers define a second plane substantially parallel to, but not coplanar with, the first plane, wherein the supporting unit comprises:

a plurality of shaft supporting members to rotatably support shafts of the plurality of transferring rollers; and a biasing unit to bias the plurality of shaft supporting members outwardly with respect to the loop of the belt, wherein the biasing unit comprises a plurality of elastic members configured to elastically bias the plurality of shaft supporting members outwardly with respect to the loop of the belt, the plurality of elastic members satisfying:

(C_middle>C_end1) or (C_middle>C_end2), wherein C_end1 represents a coefficient of elasticity of an upper one of the plurality of elastic members corresponding to the upper transferring roller; C_middle representing coefficients of elasticity of middle ones of the plurality of elastic members corresponding to the one or more middle transferring rollers; C_end2 representing a coefficient of elasticity of a lower one of the plurality of elastic members corresponding to the lower transferring roller.

8. A transfer unit for transferring developer images from a plurality of image carrying members of an image forming apparatus to a print medium, comprising:

a belt configured to rotate in a loop;

a plurality of transferring rollers disposed inside the loop to each contact the belt, the plurality of transferring rollers including an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers; and a biasing unit configured to bias the plurality of transferring rollers outwardly with respect to the loop of the belt, the biasing unit satisfying:

(F_middle>F_end1) or (F_middle>F_end2), wherein F_end1 represents an upper biasing force applied to the upper transferring roller; F_middle representing anyone of biasing forces respectively applied to the one or more middle transferring rollers; F_end2 representing a lower biasing force applied to the lower transferring roller.

9. The transfer unit according to claim 8, wherein the belt comprises one of a transport belt configured to transport the print medium to the plurality of image carrying members and an intermediate transfer belt onto which the developer images are transferred from the plurality of image carrying members.

10. The transfer unit according to claim 8, wherein each of the one or more middle rollers is applied substantially the same biasing force.

11. The transfer unit according to claim 8, wherein the upper biasing force IS different from the lower biasing force.

12. The transfer unit according to claim 8, wherein the upper biasing force is larger than the lower biasing force.

13. An image forming apparatus, comprising:

a plurality of image carrying bodies each configured carry a developer image; and a transferring unit comprising:

a belt configured to rotate in a loop;

a plurality of transferring rollers each opposingly facing a respective corresponding one of the plurality of image carrying bodies with the belt interposed therebetween, the plurality of transferring rollers including an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers; and a support unit configured to support the plurality of transferring rollers such that rotational axes of the upper and lower transferring rollers define a first plane, and such that rotational axes of the one or more middle transferring rollers define a second plane substantially parallel to, but not coplanar with, the first plane, wherein the supporting unit comprises a biasing unit configured to bias the plurality of transferring rollers in a direction toward the plurality of image carrying bodies, wherein the biasing unit exerts biasing forces that satisfy:

(F_middle>F_end1) or (F_middle>F_end2), wherein F_end1 represents an upper biasing force applied to the upper transferring roller; F_middle representing a middle biasing force applied to the one or more middle transferring rollers; F_end2 representing a lower biasing force applied to the lower transferring roller.

14. An image forming apparatus, comprising:

a plurality of image carrying bodies each configured carry a developer image; and a transferring unit comprising:

a belt configured to rotate in a loop;

a plurality of transferring rollers each opposingly facing a respective corresponding one of the plurality of image carrying bodies with the belt interposed therebetween, the plurality of transferring rollers including an upper transferring roller positioned at an upstream end of the belt with respect to a rotational direction of the belt, a lower transferring roller positioned at a downstream end opposite to the upstream end of the belt with respect to the rotational direction of the belt and one or more middle transferring rollers positioned between the upper and lower transferring rollers; and a biasing unit configured to bias the plurality of transferring rollers toward the plurality of image carrying bodies, the biasing unit satisfying:

$$(F_middle > F_end1) \text{ or } (F_middle > F_end2),$$

wherein F_end1 represents an upper biasing force applied to the upper transferring roller; F_middle representing anyone of biasing forces respectively applied to the one or more middle transferring rollers; F_end2 representing a lower biasing force applied to the lower transferring roller.

15. The image forming apparatus according to claim 14, wherein the biasing unit comprises a plurality of elastic members configured to elastically bias the plurality of transferring rollers toward the plurality of image carrying bodies, the plurality of elastic members satisfying:

$$(C_middle > C_end1) \text{ or } (C_middle > C_end2),$$

wherein C_end1 represents a coefficient of elasticity of an upper one of the plurality of elastic members corresponding to the upper transferring roller; C_middle representing coefficients of elasticity of middle ones of the plurality of elastic members corresponding to the one or more middle transferring rollers; C_end2 representing a coefficient of elasticity of a lower one of the plurality of elastic members corresponding to the lower transferring roller.

* * * * *